US007182040B2

(12) United States Patent
Pharo et al.

(10) Patent No.: US 7,182,040 B2
(45) Date of Patent: Feb. 27, 2007

(54) PERSONNEL GUIDANCE AND LOCATION CONTROL SYSTEM

(76) Inventors: Dan Pharo, 27062 Alabastro Dr., Valencia, CA (US) 91354; Alex J. Hembree, 4620 Jupitor La., Salt Lake City, UT (US) 84124

( * ) Notice: Subject to any disclaimer, the term of this patent is extended or adjusted under 35 U.S.C. 154(b) by 48 days.

(21) Appl. No.: 10/633,480

(22) Filed: Aug. 1, 2003

(65) Prior Publication Data

US 2004/0025779 A1 Feb. 12, 2004

Related U.S. Application Data

(63) Continuation of application No. 10/004,213, filed on Oct. 31, 2001, now abandoned.

(51) Int. Cl.
*G09F 19/22* (2006.01)

(52) U.S. Cl. ..... 116/200; 116/201

(58) Field of Classification Search ..... 116/200, 116/201, 205, 209, 63 R, 63 P; 404/6, 9, 404/12–14; 52/33, 38, 174, 177; 40/582, 40/612; 362/152, 153, 153.1; 340/332, 340/815.4, 944; 434/75
See application file for complete search history.

(56) References Cited

U.S. PATENT DOCUMENTS 429,650 A * 6/1890 Scott ..... 116/209
1,521,941 A * 1/1925 Graf ..... 116/63 R
1,686,363 A * 10/1928 Baldwin ..... 362/153
1,979,979 A * 11/1934 Martini ..... 47/33
1,986,097 A * 1/1935 Arey ..... 359/547
2,065,872 A * 12/1936 Rockwell ..... 40/616
2,085,807 A * 7/1937 Lindsey ..... 340/332
2,680,698 A * 6/1954 Schnee ..... 15/215
3,200,243 A * 8/1965 McDevitt et al. ..... 362/153
3,317,168 A * 5/1967 Ziph ..... 116/63 P (Continued)

FOREIGN PATENT DOCUMENTS

EP 965952 A2 * 12/1999

(Continued)

*Primary Examiner*—R. Alexander Smith
(74) *Attorney, Agent, or Firm*—Robert J. Schaap

(57) ABSTRACT

A personnel location control system for controlling and guiding a group of individuals in a selected path to a waiting point and then to an activity in advance of that waiting point. The system in one embodiment relies upon a plurality of disks or like guide path-forming elements which define the edges of a desired guide path for a line of individuals waiting to reach the activity or destination. These elements may be physically mounted on a ground cover substrate where a single substrate or a plurality of similar substrates in combination, could form a desired guide path. Thus, some of the ground substrates may define arcuate guide path sections and others may define straight guide path sections, etc., but which when combined will form a total guide path. Thus, modular carpet substrates or sections could be provided and each of these carpet sections would be capable of being secured to a ground or floor surface. In another embodiment, the guide forming elements may be integrally formed in the carpet substrates. Further, the guide forming elements may be individual carpet pieces which are located in holes formed in the carpet substrates. Thus, the various carpet substrates could all be pre-formed and merely secured to a floor at a desired location.

17 Claims, 4 Drawing Sheets

U.S. PATENT DOCUMENTS 3,453,660 A * 7/1969 Gehweiler et al. ..... 156/378
3,969,720 A * 7/1976 Nishino ..... 340/815.69
4,040,760 A * 8/1977 Wyckoff ..... 359/551
4,080,087 A * 3/1978 Phillips ..... 116/205
4,089,730 A * 5/1978 Mahn ..... 156/541
4,109,439 A * 8/1978 Feasel ..... 15/215
4,376,596 A * 3/1983 Green ..... 283/3
4,385,586 A * 5/1983 Schriever ..... 116/205
4,401,050 A * 8/1983 Britt et al. ..... 116/205
4,489,669 A * 12/1984 Carman ..... 116/202
4,570,207 A * 2/1986 Takahashi et al. ..... 340/944
4,620,816 A * 11/1986 Kupfer ..... 404/6
4,737,764 A * 4/1988 Harrison ..... 340/286.13
4,747,515 A * 5/1988 Kasher et al. ..... 221/116
4,794,373 A * 12/1988 Harrison ..... 340/286.01
4,888,896 A * 12/1989 Sanchez ..... 156/242
4,896,886 A * 1/1990 Colley ..... 473/157
5,242,242 A * 9/1993 Young ..... 404/12
5,248,152 A * 9/1993 Timmerman ..... 273/444
5,331,918 A * 7/1994 Honigsbaum ..... 116/205
5,335,112 A * 8/1994 Bennett et al. ..... 340/947
5,437,907 A * 8/1995 Peil et al. ..... 404/10
5,476,339 A * 12/1995 Baranowski ..... 404/36
5,516,277 A * 5/1996 Yanagihara et al. ..... 110/341
5,568,785 A * 10/1996 Hazen ..... 116/209
5,593,156 A * 1/1997 Jambor ..... 40/217
5,626,094 A * 5/1997 Jeffery et al. ..... 116/201
5,637,378 A * 6/1997 Hensler et al. ..... 428/192
5,678,337 A * 10/1997 Ashoori ..... 40/594
5,714,255 A * 2/1998 Yeh ..... 428/359
5,764,060 A * 6/1998 Gonzalez et al. ..... 116/205
5,775,016 A * 7/1998 Chien ..... 362/570
5,791,114 A * 8/1998 Mandel ..... 52/591.3
5,961,072 A * 10/1999 Bodle ..... 244/118.5
6,025,773 A * 2/2000 Bresnan ..... 116/205
6,082,886 A * 7/2000 Stanford ..... 362/153.1
6,176,450 B1 * 1/2001 Bergman ..... 244/1 R
6,328,500 B1 * 12/2001 Rubio ..... 104/55
2003/0152744 A1 * 8/2003 Arena ..... 428/98
2004/0013848 A1 * 1/2004 Kobayashi et al. ..... 428/85
2005/0016105 A1 * 1/2005 Wagner ..... 52/506.01

FOREIGN PATENT DOCUMENTS

JP 10008426 A * 1/1998

* cited by examiner

PERSONNEL GUIDANCE AND LOCATION CONTROL SYSTEM

RELATED APPLICATION

This application is a continuation of my U.S. patent application Ser. No. 10/004,213, filed Oct. 31, 2001, for personnel Guidance and Location control System.

BACKGROUND OF THE INVENTION

1. Field of the Invention

This invention relates in general to certain new and useful improvements in a personnel waiting guidance and control system for guiding a group of individuals in a controlled manner and through a selected path to a particular activity.

2. Brief Description of Related Art

Personnel guidance and control systems have long been used in a variety of activities for controlling the path of movement of a group of individuals to an activity. As a few simple examples, these guidance and control systems have been used for controlling a group of people waiting for one or more tellers in a banking institution or otherwise a group of people waiting to use a series of one or more automated teller machines. In like manner, these guidance and control systems are frequently used for various entertainment and amusement activities to control a group of people who are desirous of entering the activity. These systems form a selected path for entry in a controlled manner and in controlled numbers to the entertainment or amusement activity. There are numerous other activities in which these guidance and control systems have been used.

Generally, all of the conventional guidance and control systems rely upon the use of movable standing poles mounted on heavy base plates and which contain cables such as chains, ropes or the like thereby defining a pathway for the individuals. The other forms of personnel guidance and control systems rely upon lines painted on a ground surface, such as a pair of spaced apart lines, which define a guidance path to a particular activity.

Each of these commercially available guidance and control systems suffer from a number of drawbacks which somewhat limits their effectiveness. First of all, where the movable poles are employed and hold a flexible cable, personnel waiting in the lines or others either intent on theft or vandalism can mischievously move the poles with the guidance cables extending therethrough to another location. Secondly, when the poles and cables are located in an outside environment, they must be periodically removed and stored to prevent theft or vandalism, as for example, when the activity has closed. Thirdly, even at a daytime or lighted period, there are also incidents of theft and/or vandalism to either the poles or cables or both.

There have also been several incidents where children have attempted to push on the poles used for holding guide robes or similar cords. Because of the heavy weighted body portions, the poles would spring back and strike the children attempting to push on same, thereby resulting in injury. There have also been several cases where children, and even some adults, attempt to stretch elastic cables extending between the poles allowing them to elastically return to their original position. This again can result in the striking of an individual causing injury.

In the case of painted markers on the ground surface, such as a pair of spaced apart path defining lines, after a period of time, the paint forming these lines becomes worn and must again be repainted. Moreover, if there should be a change of plans to redefine the waiting path, then it is necessary to remove the existed painted lines and repaint those path defining lines in a new position. These activities are both time consuming and expensive and furthermore require periodic maintenance.

Another one of the problems with painted markers, such as painted lines, is the fact that it is virtually impossible to paint a straight line on certain ground surfaces, as for example, hand-laid tile surfaces. Due to the unevenness of the tile, it is difficult to apply a straight line. On dirt surfaces, movement of the dirt will cause disruption of the lines. Tapes have been applied to the ground surface in order to produce guidelines. Again, tapes tend to rub off and after a short period of time become tattered, if not completely removed from the ground surface. With fixed markers, there is a need for a dedicated floor space to allow sufficient room for wheelchair maneuvering and the like. However, many facilities were not designed with extra space for such movement and, to accommodate disaled people, substantial space is required.

In my aforesaid co-pending patent applications, there is set forth a system in which individual small discrete elements can be arranged on a ground surface to define a pathway of movement for a group of individuals, along with another element defining an end of the line or so-called "thread of the line" position. This system is highly effective in overcoming many of the serious drawbacks in the prior art guidance and control systems. However, the provision of the small discrete elements and an elongate element defining a head of a line position requires manual mounting to a ground surface in a desired arrangement.

The present invention provides an improvement over the personal guidance and location control system defined in that aforesaid co-pending application, in that small discrete floor covering substrate segments having the discrete elements and the elongate element pre-incorporated on these floor covering substrates allows for rapid installation. Moreover, when a user of the system desires to obtain a certain guidance and location control system, the user can provide a desired description of a floor plan and a guidance and location pathway can be pre-prepared on one or more floor covering substrates.

OBJECTS OF THE INVENTION

It is, therefore, one of the primary objects of the present invention to provide a personnel guidance and control system in which a ground covering substrate can be securely but nevertheless removably located on a ground surface and which has a guidance pathway formed thereon.

It is another object to the present invention to provide a personnel guidance and control system of the type stated in which the guidance pathway is comprised of an elongate element defining a head of line position and a group of discrete small elements extending from areas in proximity to the ends of the elongate element to define a waiting path and which elements are mounted in said ground covering substrate.

It is a further object of the present invention to provide a personnel waiting guidance and control system of the type stated in which the elongate element and the small discrete elements which form the pathway are all integral with the ground covering substrate or otherwise which are physically incorporated into the ground covering substrate.

It is also an object of the present invention to provide a personnel waiting guidance and control system of the type stated in which a plurality of separately formed ground covering substrate segments may be used and arranged together in a desired pattern in order to form a desired guidance and control path for movement of a plurality of individuals.

It is another salient object of the present invention to provide a personal waiting guidance and control system of the type stated in which a plurality of ground covering substrate segments constitute modular substrates which may be connected together and with certain of the substrates containing different shapes for portions of a guidance path, such that when assembled in a composite, they form a desired complete guide path.

It is an additional object to the present invention to provide a personnel waiting guidance and control system of the type stated which is easily and readily installed and which is reusable and requires little or no maintenance to use.

It is another salient object to the present invention to provide a method of controlling a group of individuals in a line waiting for use of a particular activity.

It is also an object of the present invention to provide a system of protecting the heavily traveled portion of carpeting and like floor material from wear.

With the above and other objects in view, our invention resides in the novel features of form, construction, arrangement and combination of parts and components presently described and pointed out in the claims.

BRIEF SAY OF THE INVENTION

A personnel waiting guidance and location control system for guiding a plurality of individuals into a line thereof and controlling movements of these individuals. The guidance and location control system comprises at least one elongate element for defining a head of the line of the individuals and represents a waiting location for the individuals at the front end or head of the line. The guidance and control system of the invention also comprises a plurality of small discrete elements in fixed locations relative to the elongate element and preferably extending from regions in proximity to the ends of the elongate element to define a path of movement for the individuals waiting in a line. In my aforesaid co-pending patent application, fastening means are provided on the underside of the elongate element and the individual discrete elements for securement into either a carpeted surface or other ground surface or the like. In this way, the individual discrete elements defining the pathway and the elongate element can be individually secured to the ground surface in a desired arrangement. This arrangement would typically define a pathway for controlling the movement of a group of people to an end of the line designation therefor.

The guidance location and control system in that aforesaid co-pending patent application is highly effective and is uniquely capable of being arranged in a variety of patterns. Thus, there is, in effect, no limitation to the number of individual patterns which can be achieved. The present invention, however, provides a modification to that system in that the individual discrete elements which form the pathway and the elongate element can all be pre-arranged and pre-located on a ground cover substrate which is then placed on the ground surface. In accordance with this system, the pattern which is desired, including the pathway for controlling the movement of a group of people, as well as the end of line position, can all be pre-formed on this ground cover substrate, which is then disposed on or secured to a ground surface.

In a preferred embodiment of the invention, the individual discrete elements and the elongate element can all be formed, for example, in a piece of carpet material which is laid over a ground surface. This carpet material, in one embodiment, could have the discrete elements and the elongate element secured by means of fasteners on the underside of each of these elements. Nevertheless, when secured to the ground cover, such as the carpet in a desired location, installation is very quick and simple, in that the ground cover substrate is then secured to a ground surface.

In another embodiment of the invention, the discrete elements and the elongate element are integrally formed into the carpet material. During the weaving process, the carpet itself may be formed of a e.g. gray colored material. However, the weaving apparatus would be pre-programmed to incorporate white areas representing the white discrete elements and elongate element. Elements of different colors could also be used. Thus, when the carpet is woven, these discrete elements and the elongate element, with the latter representing the end of the line position, would all be integral in a carpet material substrate. When the ground cover is a sheet of vinyl, the vinyl can be pre-printed with the desired pattern.

It is also possible to use the small discrete elements and/or elongate element with surfaces projecting slightly above the surface of the ground covering material as, for example, the carpet material. For example, these elements may have a dome shape or other shape to make them more prominent. In like manner, they can be slightly recessed below the surface of the floor covering material or they may be flush with the surface of the floor covering material. It is also possible to use anti-skid material on the small discrete elements or, for that matter, on the other ground covering material.

In another embodiment of the invention, holes or recesses could be formed in a carpet sheet representing a ground cover substrate and plugs of different colored carpet material would be inserted in those holes or recesses. Thus, an elongate hole or recess having the shape of the elongate element would receive an elongate element formed of the same material but of a different color than the carpet substrate. The same holds true for the small discrete elements. In like manner, a colored hardenable liquid material or semi-liquid material can be poured into holes or recesses formed in carpeting or other floor material and allowed to cure or polymerize to a hardened state. This similarly results in formation of colored elements which may either the small discrete path forming elements or the end of the line elements.

In yet another embodiment of the invention, the ground cover substrates can be provided as modular substrates. In accordance with this embodiment of the invention, a plurality of ground cover substrates are provided and with certain of the ground cover substrates having different guidance patterns of discrete elements than others of the ground cover substrates. Thus, one of the substrates will have an elongate element formed thereon as a head of a line position and few of the discrete elements thereon to represent the beginning of the pathway for a group of individuals. Another ground cover substrate could have the individual discrete elements formed thereon in a linear row. Still another ground cover substrate could have the small discrete elements formed thereon in a arcuate pattern to represent a turn in the pathway. Any of a number of patterns could be pre-formed on other ground segments.

When a user of the system desired to set up its own guidance location and control system, the user would select the desired patterns, such that the user could assemble the ground cover substrates in a desired arrangement to obtain that pathway desired by the user.

It is also possible to use other kinds of markers in place of the small discrete elements. For example, markers in the shape of an arrow or the like could be used, along with the elongate marker.

It is also possible to use individual joined substrate sections, such that the individual modular substrates can be joined together in a desired arrangement. Some of the substrate sections be arcuate in shape or even U-shaped to represent a turn in the proposed guided pathway. Any form of interlocking means for joining together two substrate sections may be employed.

It is also possible to use substrate sections which are not necessarily in a butting relationship. For example, one substrate section could be provided with small discrete elements and another substrate section spaced from the end of the first substrate section in the shape of an arrow or a arch to define an end of the line waiting position, and a further substrate could be spaced from the arrow or arch to represent the destination.

Any of a number of means for securing the ground cover substrates to a ground surface may be employed. Thus, if the ground surface is a hard surface, such as a ceramic or vinyl tile surface, an adhesive means on the underside of the ground cover substrates could be used. Otherwise, if the ground surface is a true earth material soil, then other means for securement to the soil would be required. In like manner, if the ground surface is a carpeted material, the means for securing the ground cover substrates would be in the nature of improved carpet strips or the like.

It is possible to use a wide variety of ground covering materials, such as vinyl sheet material, rubber sheet material, carpeting, and the like. Any of these materials could be provided with the location and guidance control system of the invention, as herein described.

In more detail, the elongate element may have and for that matter, the small discrete elements may have written or printed indicia on their upper surface. For example, the elongate element may have imprinted on the upper surface thereof the words "Wait Here" or "Next". In like manner, the small discrete elements may have other indicia presented on their upper surface.

In addition to the foregoing, both the elongate element and the discrete small members may have colored or reflective surfaces or sections thereof on their upper surface to further aid in guiding a path of movement of a group of individuals.

The fastening means associated with the elongate element and the small discrete elements may adopt any of a number of suitable forms. One of these forms may be an adhesive means secured to the underside of the elongate element and the small discrete elements and covered by a releasable protective strip. One of the preferred forms of fastening means is large gauged screws secured to the underside of each of these elements. These screws are effective to be rotated either into a ground cover material for retentively and securely holding the elements into the ground cover material.

This invention has many other advantages and purposes which will become more fully apparent from the following detailed description and the accompanying drawings which illustrate one of the preferred embodiments of the personnel waiting control system. However, it is to be understood that this following detailed description and the accompanying drawings are set forth only for purposes of illustrating and describing the general principles of the invention and are not to be taken in a limiting sense.

BRIEF DESCRIPTION OF THE DRAWINGS

Figure 1:
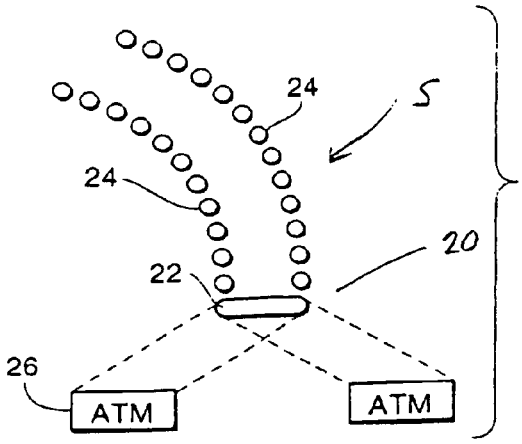
Figure 2:
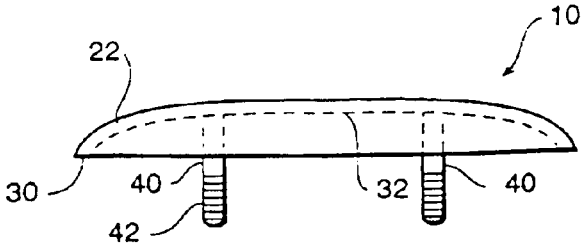
Figure 3:
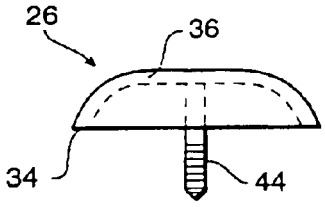
Figure 4:
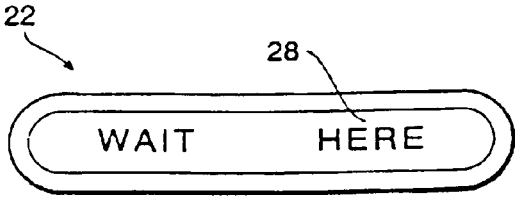
Figure 5:
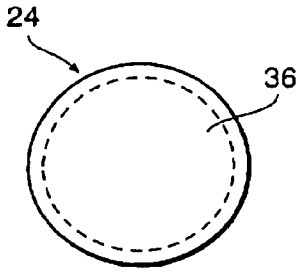
Figure 6:
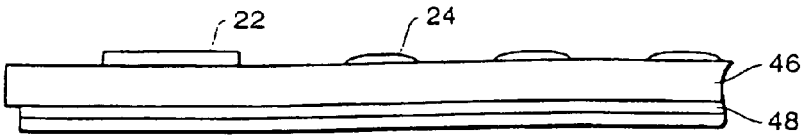
Figure 7:
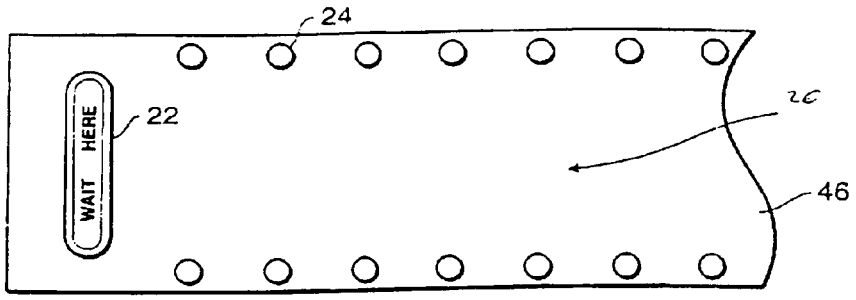
Figure 8:
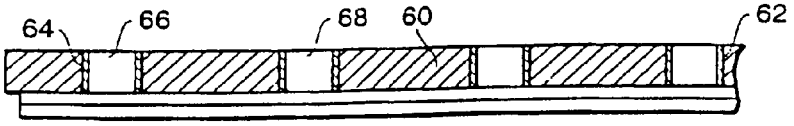
Figure 9:
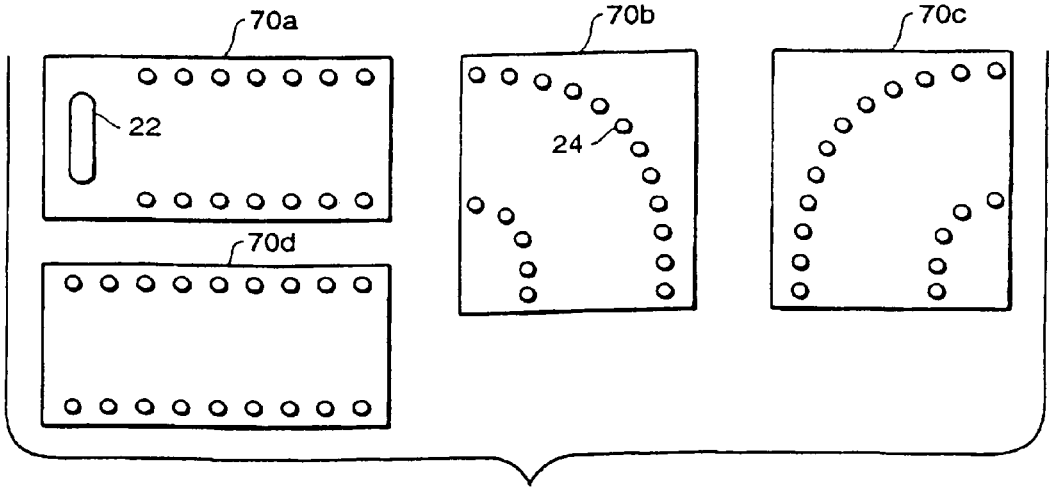
Figure 10:
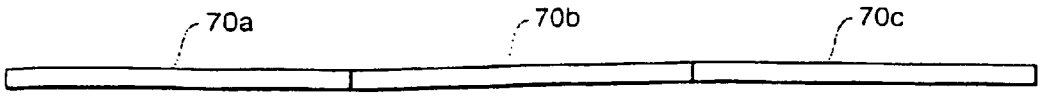
Figure 11:
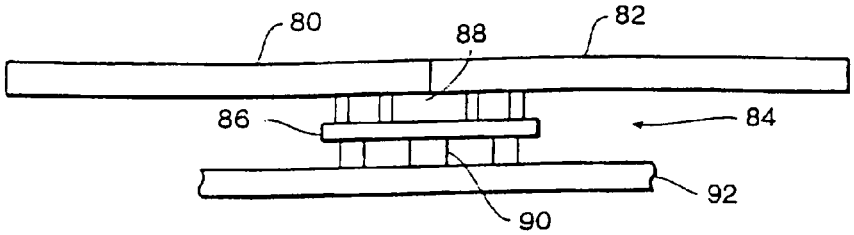
Figure 12:
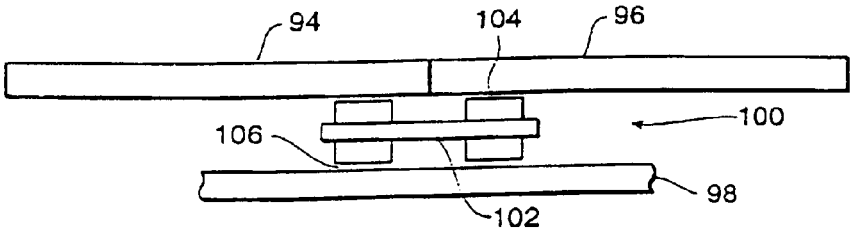
Figure 13:
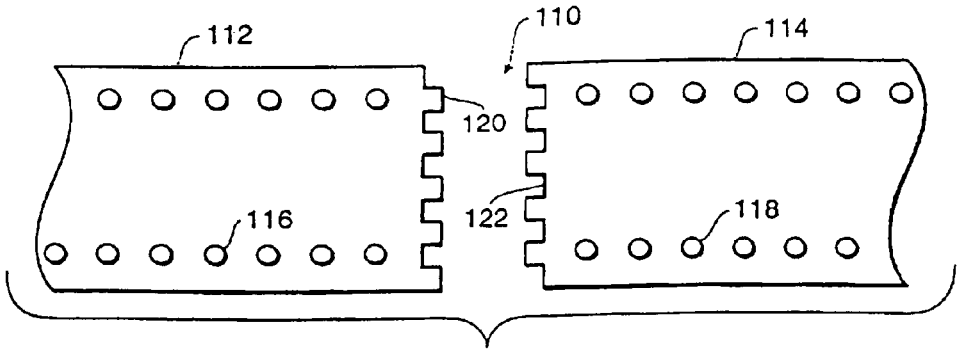
Figure 14:
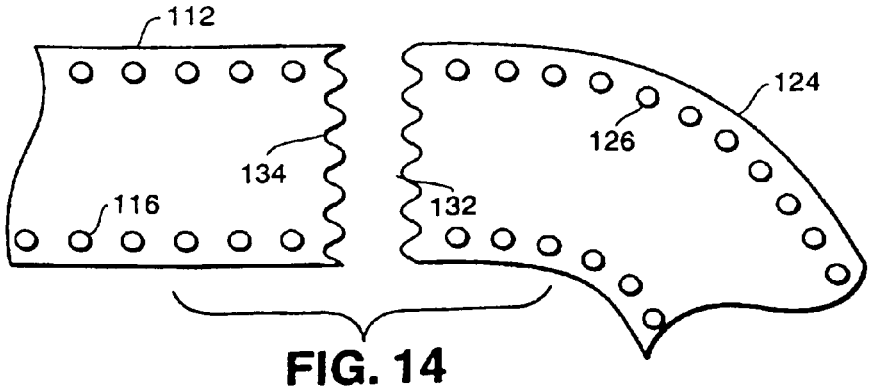
Figure 15:
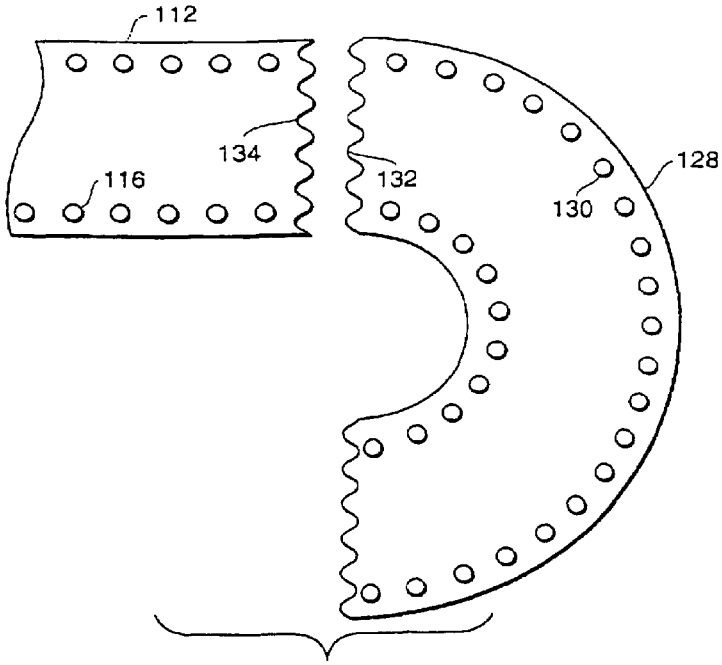
Figure 16:
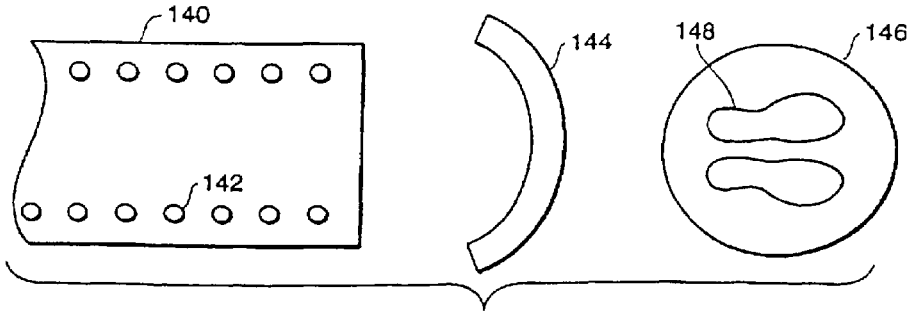
Figure 17:
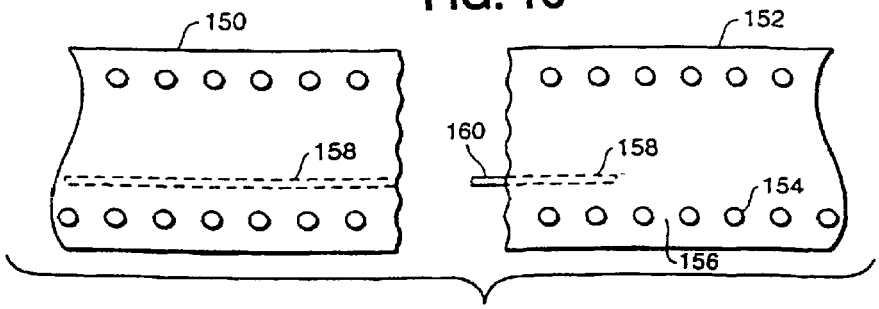

Having thus described the invention in general terms, reference will now be made to the accompanying drawings in which:

FIG. 1 is a top plan view showing one embodiment of the personnel waiting guidance and control system constructed in accordance with and embodying the present invention;

FIG. 2 is a side elevational view of the elongate element forming part of the personnel waiting guidance and control system of the present invention;

FIG. 3 is a side elevational view of one form of discrete small guide path defining element forming part of the personnel waiting guidance and control system of the present invention;

FIG. 4 is a top plan view of the one form of the elongate end of the line element forming part of the guidance and location control system of the present invention;

FIG. 5 is a top plan view of one form of discrete small guide path defining element forming part of the personnel guidance and control system;

FIG. 6 is a fragmentary side elevational view of one form of ground cover substrate forming part of a personnel guidance and location control system of the present invention;

FIG. 7 is a top plan view of one form of ground cover substrate forming part of the personnel guidance and location control system of the present invention;

FIG. 8 is a fragmentary vertical sectional view showing another embodiment of a ground cover substrate forming part of the personnel guidance and location control system of the present invention;

FIG. 9 is a composite of individual ground cover substrates in modular form which can be arranged in a desired combination to form a guidance and location control system in accordance with the present invention;

FIG. 10 is a side elevational view showing an arrangement of ground cover substrates connected together;

FIG. 11 is a fragmentary side elevational view showing one means for securing ground cover substrates to a carpeted ground surface;

FIG. 12 is a fragmentary side elevational view showing another means for securing ground cover substrates to a hard ground surface;

FIG. 13 is a fragmentary plan view showing the joiner of a pair of substrate sections to form a part of a guidance path;

FIG. 14 is a fragmentary plan view showing a modified pair of substrate segments forming an alternate type of pathway;

FIG. 15 is a fragmentary plan view, similar to FIGS. 13 and 14, and showing still other forms of substrate sections joined together to form a pathway;

FIG. 16 is a plan view showing unattached substrate sections which form a guidance and location control path; and FIG. 17 is a fragmentary plan view showing the joinder of a pair of substrate sections with electrical current carried through the substrate sections.

DETAILED DESCRIPTION OF A PREFERRED EMBODIMENT

Referring now in more detail and by reference characters to the drawings which illustrate a preferred embodiment of the present invention, S designates a personnel guidance and location control system comprised primarily of a ground cover substrate 20, as hereinafter described in more detail. Mounted in the substrate 20 is an elongate element or member and referred to as a "head of the line" element 22 and a group of small discrete path defining elements 24.

The elongate element 22 and the path defining discrete elements 24 are preferably located on the ground cover substrate 20 in a particular arrangement to define a path of movement of a group of individuals in a waiting area so that each of the individuals may then advance to a selected activity or destination.

In accordance with the present invention, and merely for the purposes of illustrating the present invention, the personnel waiting guidance and control system shows the location of the entire substrate 20 including the elongate element 22 and the small discrete elements 24 forming a waiting line to one or more automated teller machines 26. However, it should be understood that the use of the personnel guidance and control system in connection with the automated teller system designated as "ATM" is only for purposes of illustrating the principles of the invention and that the invention is operable with countless other activities or destinations at the end of a line.

The elongate element 22 may have imprinted on its upper surface, or otherwise applied to the upper surface, certain indicia 28 thereon (as shown in FIG. 4) for providing instructions to the group of individuals. As a simple example, the indicia 28 on the elongate element 22 may read "Wait Here" or "Next", or other similar words which define a location in which individuals at the head of a line are requested to wait. Thus, in the case of an automated teller machine, the individual at the head of the line will wait his or her turn to use the automated teller machine until completion of use by a party presently at the automated teller machine.

The holding of a line of individuals at a pre-selected distance away from the automated teller machine will also allow any security camera associated with that teller system to properly scan the line of individuals waiting to use the machine. Thus, if a security problem should arise and which can be observed by the camera system or if there is another problem in the line of individuals, that is scanned by the camera system, a potential intervening action may be taken. Thus, the control system of the invention provides an added degree of security. Also, the system of the invention is effective in maintaining an orderly organization of people as, for example, in a restaurant. Thus, the system of the invention could be used to cause people to form a line which ends a distance away from a restaurant counter, thereby allowing people who have ordered to pick up the ordered food without congestion and potential accident.

In the embodiment of the invention as illustrated, the elongate element 22 has somewhat of an inverted dish-shaped construction and is formed on its underside with an angular downwardly facing rim 30 and a recessed bottom wall 32. This construction renders a light weight elongate element 22 without materially affecting its structural properties. Moreover, the recessed bottom wall also, in certain embodiments, allows for a convenient stacking and nesting of the elongate elements for purposes of shipping and storage.

The small discrete elements 24 forming part of the personnel guidance and control system of the invention are circular in shape, as shown in the top plan view thereof. Moreover, each of the small discrete elements 24 have recessed bottom walls, such that they form an annular downward facing rim 34 and a recessed bottom 36, all in the manner as best illustrated in FIG. 6 of the drawings. The lower edges of each of the discrete elements 24 are adapted for engagement with the ground cover substrate 20 and are located at an angle such that the sole or heel of a shoe will not catch on that lower edge and these edges will also allow wheelchairs to easily roll over the discrete elements.

In accordance with the present invention, and particularly by reference to FIG. 1, it can be seen that the elongate element 22 and the small discrete elements 24 can be located on a ground cover substrate in a desired arrangement in order to achieve a guidance path and a head of a line position for a group of individuals. One of the important aspects of the present invention is that this personnel guidance and control system is not readily subjected to damage or theft and can be relatively fixedly secured to a ground surface, but yet removable from one location and used in another location.

In one embodiment of the present invention, the elongate element 22 is provided with a plurality (a pair as shown) of spaced apart screws 40 which may be inserted into a ground cover substrate, such as a carpeted ground cover substrate. Moreover, these screws 40 allow for fastening fitting within a carpet for retentive securement thereto. In this case, the screws have a fairly coarse thread 42 thereon such that the discrete elements may be pushed downwardly on a carpet substrate so that the screws are forced into the carpeting material. When only one screw is employed, the threads would also be coarse to thereby only allow a minimal number of turns of the screw. In this way, where the screws are used for securing the elongate element 22 to a carpet-like fabric material, they will not tear the material and only engage the pile of the carpet or rug.

It is also possible to secure the small discrete elements to a ground cover substrate, as for example, by means of an adhesive securement or otherwise by means of screws, such as the screws 44.

FIG. 3 more fully illustrates a single screw 44 molded into each of the small discrete path defining members 24. Again, this screw 44 has a large diameter thread which is relatively coarse and only permits a limited number of turns, much in the same manner as the screws 40, in the elongate element 22.

The small discrete path defining elements 24 may have an adhesive strip on the downwardly presented rim thereof. Moreover, the adhesive strip may be covered with a releasable and removable protective backing, if desired. In accordance with this construction, the removable backing strip can be removed for allowing the adhesive strip to become secured to a ground cover substrate.

It should be understood that the elongate element 22 could also be provided with adhesive strips on its downwardly facing rim 30. Thus, and in this way, the elongate element can be secured to a ground cover substrate much in the same manner as the small discrete elements.

As indicated previously, the present invention utilizes a ground cover substrate which is disposed on a ground surface. The ground surface may be any form, such as a ground soil surface, or otherwise it may be a manufactured surface, such as a wooden surface, a vinyl tile or ceramic tile surface or, for that matter, a wood surface. With hard covered surfaces, the ground cover substrate is frequently provided with an adhesive means and preferably a releasable adhesive means so that the ground cover substrate can be removed from the ground surface. In the case of a carpeted or rug surface, the ground cover substrate may be secured through improved carpet strips in a manner as hereinafter described.

In the present invention, each of the elongate elements 22 and the small discrete elements 24 can be pre-mounted on a ground cover substrate, as aforesaid. In this way, it is only necessary to apply the ground cover substrate to a ground surface.

FIG. 6 shows an embodiment of the invention in which there is an elongate element 22, such as a head of a line element, and a plurality of discrete path-defining elements 24 starting from opposite sides of the elongate element defining a path, much in the manner as shown in FIG. 1 and, for that matter, in FIG. 6. The ground cover substrate 46 in this embodiment may adopt the form of either a relatively rigid material, such as a vinyl tile material or the like, or it may adopt the form of a fabric material, such as a carpet. FIG. 6 illustrates a ground cover material 46, such as a relatively rigid type material, e.g. a vinyl ground covering material, having an adhesive surface 48 on its underside. The adhesive is covered by a releasable backing 50, such that when the backing 50 is removed, the adhesive 48 can be secured to a ground surface as, for example, another manufactured and rigid surface. The term "ground surface" is used herein to reflect any surface to which the substrate is applied and does not necessarily imply a ground soil surface.

It is also possible to place a fiber fastening attachment material, such as the so-called "Velcro" material, in a recess formed in a ground surface material and to employ mating fiber fastening material on the bottom of pre-formed small discrete elements or elongate end of the line elements. In a like manner, these elements may also have representations, such as, for example, Christmas decorations or Easter decorations, etc. Thus, the discrete elements and the elongate element can be periodically changed as desired to accommodate seasons or other conditions.

FIG. 7 illustrates an embodiment of the invention in which there is a ground cover substrate 46 having the elongate head of the line element 22 and the individual discrete path-defining elements 24. In this particular case, the path-defining elements are located at each of the sides of the ground cover substrate 46 to form an individual pathway 48. However, it should be understood that the individual discrete elements could be located in a different arrangement, such as to form an arcuate path or the like.

In the embodiments of the invention as shown in FIGS. 6 and 7, the elongate element 22 and the individual discrete elements 24 may be integrally formed in the ground cover substrate 46 in any of a variety of fashions. As indicated previously, the elongate element 22 and the discrete path-forming elements 24 may be woven into a carpet ground cover substrate. Otherwise, if the ground cover substrate is relatively hard material, such as a vinyl, they can be pre-printed onto the vinyl. Further, they can be painted onto the ground cover substrate, or otherwise applied. In all cases, the individual ground cover substrates 46 can then be taken to a site of use and readily and easily applied to the ground surface as, for example, through an adhesive layer 48 in connection with the embodiment of FIG. 6. In like manner, screws may also be provided on the underside of the ground cover substrate 46 for securement to a relatively rigid ground cover surface. The ground cover substrates may be releasably secured to the ground in any other fashion or, for that matter, they may be merely laid upon the ground surface.

FIG. 8 illustrates an embodiment of the invention in which there is a carpet material ground cover substrate 60. The carpet substrate 60 is provided with a plurality of openings 62 for the individual discrete elements and an enlarged opening 64 for the elongate element 22. In this particular case, a plug 66 having the size of an elongate element, but of a different color than the carpet 60, is inserted in the enlarged opening 64. In each of the other openings 62 there are provided plugs 68 representing the small discrete path-defining elements. These plugs 68 would also have a different colored surface than the carpet substrate 60. In addition, each of the individual plugs 66 and 68 can be provided with a slightly raised surface, as-shown in FIG. 8, if desired.

In another embodiment of the invention, modular ground cover substrates 70 could be provided, as shown in FIG. 9. There is a first substrate 70*a* which has an elongate element 22 formed on the surface thereof or incorporated in the material thereof. A second carpet substrate 70*b* has a plurality of small discrete elements 24 located in somewhat of an arcuate path and thereafter leading into a straight or linear path. In this way, by combining the substrates 70*a* and 70*b*, one could form the start of a personnel guidance path which then has an arcuate turn in approximately a 90° direction. By adding a further substrate 70*c*, which also provides an arcuate turn in an opposite direction, one could further alter the guidance path. By adding a further substrate 70, which also has elongate columns of small discrete elements, a linear path-defining portion would be added to the arcuate path of the substrate 70*b*.

These various substrates 70*a* through 70*d* all show various modular ground cover substrates which can be used in the invention and show a limited number of various discrete path-defining element arrangements. It should be understood, however, that these various substrates 70*a* through 70*d* are only illustrative of the numerous embodiments of the invention would could be obtained. Thus, rectangularly shaped corner portions could be provided and arcuate corner portions with very small or very large angles could also be provided. In addition, various other designs could be provided on a substrate for insertion between two other substrates defining a pathway to add some variation in design to the pathway.

In accordance with the present invention, a user can obtain a plurality of individual modular substrates and arrange these substrates in a pattern which suits the particular user. Thus, for example, the user could abut three ground cover substrates, such as, for example, the ground cover substrates 70*a*, 70*b* and 70*c* together in a manner as shown in FIG. 10. These ground cover substrates could be merely laid upon a ground surface or otherwise secured to the ground surface.

In the case where the ground cover substrates are formed of a carpeted material, the ground cover substrates, such as substrates 80 and 82, may be secured to another carpeted ground surface by means of specially designed carpet strips 84. Each carpet strip 84 comprises a small flat metal substrate 86 which has nails or similar pointed prongs 88 on the upper surface for insertion into the carpet substrates 80 and 82 and nails 90 on the undersurface for insertion into the carpeted ground surface 92. In this way, the strips 84 hold the two ground cover substrates 80 and 82 in an abutted position on a carpeted ground surface 92. It also possible to use fiber fastening attachment strips for connecting the abutting ends of carpet segments together.

FIG. 12 illustrates an embodiment where two relatively rigid ground cover substrates 94 and 96 are abutted against one another to form a desired pattern on the upper surface. These two ground cover substrates 94 and 96 are, in turn, secured to a relatively rigid ground cover, such as a ceramic tile surface 98, by means of fastener strips 100. In this case, the fastener strips 100 also may have a metal substrate or other hard substrate 102, along with adhesive surfaces 104 on the upper portion thereof and adhesive surfaces 106 for securement to the ground surface 98.

It should be understood that the fastener mechanisms for securing the various ground cover substrates to the ground surface are only illustrative of a large number of mechanisms which could be employed for this purpose. Thus, fiber fastening strips and the like could be used.

It should be recognized that indicia could be incorporated on the small discrete path-forming elements, as well as the elongate element. For example, arrows could be formed on one or more of the small discrete path-defining elements. In this way, the arrows or other indicia literally co-act with the small discrete elements in defining a path. It should also be understood that the discrete path-defining elements could have other shapes, as opposed to a circular shape as shown. Thus, the small discrete path-defining elements 24 may have the shape of an arrow. In addition, the small discrete path-defining elements and the elongate head of the line element may all have light emitting diodes for lighting the path which is formed. Moreover, these diodes could remain in a permanently lit condition or they could be energized sequentially, as hereinafter described.

It is also possible to provide interlocking means for releasably connecting each of the substrate sections together in a desired guide forming path. FIG. 13 illustrates one such interlocking arrangement 110 on a pair of linearly located substrate sections 112 and 114, which each have small discrete guide path forming elements 116 and 118 on their upper surfaces. In this particular case, it can be observed that the interlocking arrangement 110 comprises teeth 120 on one of the substrate sections and mating interlocking teeth 122 on the other of the substrate sections 114.

It is also possible to provide substrate sections which are not necessarily linear, as shown in FIG. 13. For example, FIG. 14 shows a substrate section 112, similar to that previously described, and an arcuately shaped substrate section 124, also having small discrete path forming elements 126 on its upper surface. Other shapes of substrate sections could also be employed, such as the U-shaped substrate section 128 illustrated in FIG. 15, and which also has the small discrete path forming elements 130 on its upper surface.

In the embodiment of the invention as shown in FIG. 14, there is a also a modified form of interconnecting means which includes a somewhat serrated edge 132 on the arcuate substrate section 124 and a mating and corresponding serrated edge 134 on the generally linear substrate section 112. A similar interlocking means is provided for the sections as shown in FIG. 15, although it should be understood that any form of interlocking means could be used.

It is not always necessary to actually physically abut the individual substrate sections forming a guide path or to interlock same. For example, the individual pieces forming a guide path could also be used in a spaced apart relationship with sizes, shapes and locations which identify a particular guide path. For example, with a group of individuals who are to be processed as, for example, by having photographs taken, a linear substrate section 140 may be provided with the discrete path forming elements 142 on each of the opposite edges thereof. This linear section 140 thereby defines a particular guide path for a group of individuals.

In place of having a head of line position, an individual arcuate section 144 is spaced from the right-hand end of the linear substrate section 140, as shown in FIG. 16. This arcuate section could represent, for example, a next in line position to reach a destination 146. The arcuate section could be replaced by an arrow or the like, as well. The destination 146 is the activity reached by the party at the very head of the line to have the activity occur. Thus, for motor vehicle registration, where photographs are employed, the destination 146 may be a specified area of substrate section and may even have an imprint of shoes 148 on its upper surface to identify a location where that individual would stand during the taking of a photograph.

FIG. 17 illustrates an embodiment of the invention utilizing a pair of substrate sections 150 and 152 which, in this particular embodiment, are as linear substrate sections. However, they may be arcuate substrate sections, U-shaped sections, or any other shape of substrate section. Furthermore, and in this embodiment, the individual path forming elements are rows of light emitting diodes 154 and 156 adjacent the longitudinal edges thereof. In this respect, the light emitting diodes function as the small discrete path forming elements previously described.

In order to provide electrical current to these light emitting diodes, and particularly where the substrate sections 150 and 152 are carpet sections, electrical conductors 158 can be extended through the individual carpet sections, as shown. These electrical conductors would be connected to the individual light emitting diodes by branches (not shown). Moreover, in order to connect the abutting or interlocking ends of each of the substrate sections 150 and 152, one of the substrate sections is provided with an outwardly struck tab or prong 160 adapted to fit within a socket 162 formed in a conductor 158, in the manner as best shown in FIG. 17. It should be understood that any other type of electrical light pattern could also be employed using the electrical conductors as shown in the substrate sections of FIG. 17.

Thus, there has been illustrated and described a unique and novel personnel guidance and location control system which meets and fulfills all of the objects and advantages which have been sought. It should be understood that many changes, modifications, variations and other uses and applications will be become apparent to those skilled in the art after considering this specification and the accompanying drawings. Therefore, any and all such changes, modifications, variations and other uses and applications which do not depart the spirit and scope of the invention are deemed to be covered by the invention.

The invention claimed is:

1. A personnel guidance and location control system for guiding a group of walking pedestrian individuals into a line thereof in a relatively narrow pedestrian pathway and controlling movement thereof while advancing toward an activity at or beyond an end of a line position, said guidance and location control system comprising:

a) a ground cover substrate for disposition on a ground surface and having an upper surface thereon;

b) at least one end of the line element associated with said upper surface of said cover substrate and in a fixed location thereon as an end of the line for a queue of the individuals;

c) a pair of path forming guidance members associated with said upper surface of said cover substrate and on opposite sides of said substrate and in a fixed location thereon relative to the end of line element and extending from regions in proximity to opposite ends of the end of line element initially generally perpendicular to the end of the line element to form parallel pathway boundaries in a desired orientation which define a pathway of movement for the group of individuals;

d) wait state indicia associated with the end of the line element defining the end of the line element as a location for a queue of said pedestrian individuals;

e) at least one movement indicator element on said pathway of movement to indicate a movement direction in that pathway and which leads to the end of the line position, said upper surface of said substrate being relatively free of elements which would obstruct the prominence of the end of the line element, the wait state indicia, and the lines of path forming guidance members and the at least one movement indicator element so that the pathway is not visually obstructed;

f) said substrate having a width and wherein said width of the substrate or the width of said parallel pathway boundaries or a combination thereof are arranged to cause movement of said group of pedestrian individuals into a line of individuals;

g) means associated with said end of line element and path forming members for locating same with the cover substrate; and h) whereby the ground substrate having said at least one end of line element, said pair of discrete path forming guidance members, said width and said at least one movement indicator element form a means for queuing said group of pedestrian individuals into said line of individuals for movement to said at least said end of the line element having said wait state indicia;

(i) said guidance and location control system being rollable for storage, light in weight to be immediately installable and sufficiently narrow to be used in confined locations.

2. The personnel guidance and location control system of claim 1 further characterized in that the end of the line element is an elongate element and the wait state indicia is provided on the upper surface of the elongate element.

3. The personnel guidance and location control system of claim 1 further characterized in that the means for locating comprises a fastening means associated with the underside of the end of line element and with the path forming guidance members, the underside of the small discrete path forming elements having means for securing same to said ground cover substrate.

4. The personnel guidance and location control system of claim 3 further characterized in that the fastening means associated with the underside of the end of the line element and the path forming guidance elements is an adhesive strip.

5. The personnel guidance and location control system of claim 3 further characterized in that the fastening means associated with the underside of the end of the line element and the path forming guidance elements is a downwardly projecting screw.

6. The personnel guidance and location control system of claim 1 further characterized in that said end of the line element and the path forming members are fitted into recesses formed in the ground cover substrate for holding same and have surfaces at the surfaces of the substrate.

7. The personnel guidance and location control system of claim 1 further characterized in that the substrate is a carpeting material and the end of the line element and the path forming members are formed integrally in said substrate and appear at the upper surface of the substrate.

8. The personnel guidance and location control system of claim 1 further characterized in that the end of the line element and the path forming members are located on and appear on said upper surface of said substrate.

9. The personnel guidance and location control system of claim 1 comprising a plurality of said substrates, and having arrangement means associated with each of said substrates enabling said substrates to be arranged relative to one another with an end of one substrate abutted against or closely spaced to an end of a next adjacent substrate to form a desired orientation for that pathway and to avoid obstructions of an existing environment.

10. A personnel guidance and location control system for guiding a group of pedestrian individuals into a pedestrian pathway and controlling movement thereof and to an activity at the end of that pathway, said guidance and location control system comprising:

a) a plurality of ground cover substrates for disposition on a ground surface;

b) at least one elongate end of a line element associated with an endmost of said cover substrates for securement at a fixed location thereon, said at least one elongate element comprising wait state indicia defining said fixed location as an end of a line for a queue of individuals;

c) a pair of spaced apart rows of path forming members associated with said ground cover substrates in fixed locations relative to the elongate element and extending from opposite ends of the elongate element creating a pair of spaced apart pathway boundaries to define the pedestrian pathway of movement for the queue of individuals;

d) said substrates having a width and wherein said width of the substrates or the width of said pair of spaced apart pathway boundaries or a combination thereof are adapted to arrange said group of pedestrian individuals into a line of individuals;

e) at least one movement indicator element on said pathway between the spaced apart pathway boundaries, said at least one movement indicator indicating a direction of movement along the pathway to the elongate element and the end of a line position defined thereby and to a destination in advance of that end of the line position;

f) means associated with said elongate element and said path forming members for locating same with the ground cover substrates, whereby the ground cover substrates and elongate element and path forming members can be located on the ground surface and arranged in a desired orientation to conform to an existing environment so as to optimize use of pedestrian walking space in that existing environment;

g) said ground cover substrates have end margins on said substrates so that one substrate is capable of being arranged in abutting relationship with another substrate to define the pedestrian pathway for the queue of individuals;

h) whereby the substrates having the at least one elongate element, the spaced apart rows of path forming members, said width and said elongate element and said at least one movement indicator form a means for queuing the pedestrian individuals into a line of such individuals for moving them along said substrate and to the elongate end of a line element having the wait state indicia, the guidance and location control system constitutes a complete and self-contained system which is sufficient to induce pedestrian personnel to enter into the pathway and to follow the pathway; and i) said guidance and location control system being usable in confined locations and which also does not constitute an interference for un-ambulatory individuals allowing them to use the system and further does not constitute a visual obstruction, thereby effectively and efficiently controlling movement of a large number of pedestrian individuals.

11. The personnel guidance and location control system of claim 10 further characterized in that said path forming members extend from regions in proximity to opposite ends of the elongate element and are arranged at a width less that the width of a conventional passenger automobile.

12. The personnel guidance and location control system of claim 10 further characterized in that the wait state indicia is provided on the upper surface of the elongate element.

13. The personnel guidance and location control system of claim 10 further characterized in that fastening means is associated with the underside of the elongate element and with the underside of the path forming members, and that the fastening means comprises a downwardly projecting threaded member.

14. The personnel guidance and location control system of claim 10 further characterized in that fastening means is associated with the underside of the elongate element and the path forming members, and that the fastening means is an adhesive strip.

15. The personnel guidance and location control system of claim 10 further characterized in that said end of the line element is located on a substrate which is spaced slightly apart from an end of the other substrates to represent an end of the line position, but which is cooperatively located with respect to such other substrates to identify an end of the pathway.

16. The personnel guidance and location control system of claim 10 further characterized in that the path forming members each comprise a plurality of small discrete path forming elements.

17. A method for guiding a group of walking pedestrian individuals into a line thereof in a relatively narrow pedestrian pathway and controlling movement thereof to an activity in advance of that end of the line position, said method comprising:

a) providing a ground cover substrate and locating same on a ground surface and said substrate having an upper surface thereon;

b) providing on said substrate an end of the line element defining an end of a line position on the ground cover substrate for the group of walking pedestrian individuals and representing a waiting location on said upper surface for the individual at the front end of the line;

c) providing wait state indicia defining the end of the line for a queue of the individuals;

d) providing side margins defining the pathway of movement with a pair of discrete path forming guidance members on said upper surface of said cover substrate and on opposite sides of said substrate and in a fixed location thereon relative to the end of line element and extending from regions in proximity to opposite ends of the end of line element and generally perpendicular to the end of the line element, said pathway of movement having a width sufficient to arrange said group of pedestrian individuals into a line of individuals;

e) at least one movement indicator element on said pathway of movement between the spaced apart pathway side margins and providing a direction of movement to the end of a line position;

f) establishing a width of said substrate and wherein said width of the substrate or the width of said pathway side margins or a combination thereof are adapted to arrange said group of pedestrian individuals into a line of individuals; and g) whereby the ground cover substrate having the end of the line element, said path forming guidance members, said width, and said at least one movement indicator cause a queuing of said group of pedestrian individuals into said line of individuals along said substrate to said end of the line element having said wait state indicia.

* * * * *